US012460855B2

(12) United States Patent
Wentz et al.

(10) Patent No.: US 12,460,855 B2
(45) Date of Patent: Nov. 4, 2025

(54) COOLERS WITH TELESCOPING APPARATUS FOR ACCESS OF SEPARATE CONTENTS

(71) Applicants: Chris Wentz, Clovis, CA (US); Tatiana Wentz, Clovis, CA (US)

(72) Inventors: Chris Wentz, Clovis, CA (US); Tatiana Wentz, Clovis, CA (US)

( * ) Notice: Subject to any disclaimer, the term of this patent is extended or adjusted under 35 U.S.C. 154(b) by 0 days.

(21) Appl. No.: 18/201,682

(22) Filed: May 24, 2023

(65) Prior Publication Data

US 2024/0125534 A1 Apr. 18, 2024

Related U.S. Application Data

(60) Provisional application No. 63/416,360, filed on Oct. 14, 2022.

(51) Int. Cl.
*F25D 3/08* (2006.01)
*F25D 31/00* (2006.01)

(52) U.S. Cl.
CPC ..... *F25D 3/08* (2013.01); *F25D 31/007* (2013.01); *F25D 2325/00* (2013.01); *F25D 2331/804* (2013.01)

(58) Field of Classification Search
CPC ..... F25D 3/08; F25D 31/007; F25D 2325/00; F25D 2331/804; F25D 2331/809; F25D 2331/806; F25D 11/003; F25D 3/06
See application file for complete search history.

(56) References Cited

U.S. PATENT DOCUMENTS 4,576,272 A * 3/1986 Morgan et al. ..... F25D 31/007 194/215
4,721,237 A 1/1988 Leslie
4,765,151 A * 8/1988 Bessey ..... F25D 3/06 62/239

(Continued)

FOREIGN PATENT DOCUMENTS

CN 205919594 U 2/2017

OTHER PUBLICATIONS

Goat Boxco, The HUB 70 system, https://goatboxco.com/products/the-hub-70-with-cans?variant=42785584185573&currency=USD&utm_medium=product_sync&utm_source=google&utm_content=sag_organic&utm_campaign=sag_organic&gclid=CjwKCAjwyryUBhBSEiwAGN5OCIfMT3mle-PQBDxogJAFdx0y8s0Pk7GxjETDdJTa7dLkejvVtc4sABoCPX4QAvD_BwE.

(Continued)

*Primary Examiner* — Jerry-Daryl Fletcher
*Assistant Examiner* — Dario Antonio Deleon
(74) *Attorney, Agent, or Firm* — UCLA Patent Law Clinic

(57) ABSTRACT

Systems and methods for a cooler with a telescoping apparatus for access of separate contents to the main container are disclosed. In one embodiment, a telescoping cooler for access into an insulated container is provided, the telescoping cooler comprising a telescoping bar having a compressed configuration and an extended configuration, wherein the telescoping bar in the extended configuration allows a user to exchange one or more contents of a connected carrier train without opening a primary opening of the insulated container; the connected carrier train attached to the telescoping bar, wherein the connected carrier train comprises a plurality of compartments for holding the one or more contents; a cache enclosure separating the connected carrier train from the insulated container when the telescoping bar is in the compressed configuration.

14 Claims, 13 Drawing Sheets

(56) References Cited

U.S. PATENT DOCUMENTS

| | | | | |
|---|---|---|---|---|
| 4,848,856 | A * | 7/1989 | Dyment et al. | F25D 25/027 312/135 |
| 5,878,593 | A * | 3/1999 | Lane et al. | F25D 3/08 62/457.5 |
| 5,956,968 | A * | 9/1999 | Grabowski | F25D 3/08 62/457.2 |
| 6,109,059 | A | 8/2000 | Lebrun | |
| 6,895,778 | B1 | 5/2005 | Ackerman | |
| 7,013,671 | B1 | 3/2006 | Bolda | |
| 7,168,263 | B1 | 1/2007 | Zenner | |
| 7,296,434 | B2 | 11/2007 | Scroggs | |
| 7,334,802 | B2 | 2/2008 | Kaplan | |
| 7,415,794 | B1 | 8/2008 | Thompson | |
| 7,823,750 | B2 | 11/2010 | Carter et al. | |
| 8,230,697 | B2 | 7/2012 | Lavallee | |
| 8,256,156 | B1 * | 9/2012 | Burgoyne, Jr. | A45C 11/20 62/457.7 |
| 8,505,726 | B1 * | 8/2013 | Woog | F25D 31/007 62/457.5 |
| 9,310,118 | B2 | 4/2016 | Zavitsanos | |
| 9,433,200 | B2 | 9/2016 | Norman | |
| 9,476,638 | B1 | 10/2016 | Tyler | |
| 9,652,923 | B2 | 5/2017 | Doom | |
| 9,878,841 | B2 | 1/2018 | Holderness et al. | |
| 10,065,848 | B2 | 9/2018 | Volin | |
| 10,167,184 | B1 | 1/2019 | Samples | |
| 10,345,026 | B2 | 7/2019 | Fire | |
| 10,443,918 | B2 | 10/2019 | Li et al. | |
| 11,067,327 | B2 | 7/2021 | Alexander et al. | |
| 2005/0087538 | A1 | 4/2005 | Wolfe et al. | |
| 2008/0093384 | A1 | 4/2008 | Fire et al. | |
| 2008/0245095 | A1 | 10/2008 | Schlipman et al. | |
| 2010/0212351 | A1 | 8/2010 | Chapin et al. | |
| 2016/0091239 | A1 | 3/2016 | Beland | |
| 2018/0141718 | A1 | 5/2018 | Ahlström et al. | |
| 2019/0234675 | A1 | 8/2019 | Zvida | |
| 2020/0300534 | A1 * | 9/2020 | Wilkerson et al. | F25D 3/08 |

OTHER PUBLICATIONS

Suncast, 77 Qt. Gallon Deck Cooler, https://www.wayfair.com/Suncast-77-Qt.-Gallon-Deck-Cooler-DCCW3000-L731-K~XA1159.html?refid=FR49-XA1159.

Dometic, Dometic CFX3 75D7, https://www.dometic.com/en-us/outdoor/food-and-beverage/coolers/electric-coolers/dometic-cfx3-75dz-220585?adcopylabel=&contenttype=&gclid=CjwKCAjwyryUBhBSEiwAGN5OCPNnnwEQuZCpzH5cBkgl-xEPI98qOuJoVzaH7_BWgzHM7-Gvory-gRoC6gIQAvD_BwE.

Coca-Cola 8 Can Portable Mini Fridge w/ 12V DC and 110V AC Cords, https://www.amazon.com/dp/B0187KYRQC?tag=bestseller087e-20&linkCode=osi&th=1&psc=1&keywords=Coolers%20%26amp%3B%20Refrigerators.

Soda, Beer, Coke, Can Dispenser Refrigerator Beverage Rack Storage Holder, https://www.ebay.com/itm/Soda-Beer-Coke-Can-Dispenser-Refrigerator-Beverage-Rack-Storage-Holder-/251569095476.

DIY wood and acrylic can dispenser, https://www.pinterest.com/pin/517069600972413645/.

MDesign, Large Plastic Standing Pop/Soda Can Dispenser, https://thetoyvn.com/product/mdesign-large-plastic-standing-pop-soda-can-dispenser-storage-organizer-bin-for-kitchen-pantry-countertops-cabinets-refrigerator-compact-vertical-holder-8-pack-clear/.

UCTOP Store, Can Organizer Soda Can Dispenser, https://botswana.desertcart.com/products/50050454-uctop-store-can-organizer-soda-can-dispenser-useful-refrigerator-storage-box-kitchen-accessories-beverage-can-rack-four-case-sauce-bottle-container.

6 Brilliant Ways to Organize All Your Canned Goods, https://www.thekitchn.com/canned-food-storage-260784.

2 Pack Soda Can Organizer Rack for Pantry, Stackable Beverage Soda Can, https://www.ebay.com/itm/373962418767?norover=1&siteid=1&mkevt=1&mkcid=16&chn=psoc.

BXYSSCZSH-CF45001v1, 45L Compressor Portable Small Refrigerator, https://www.vevor.com/car-refrigerator-c_10723/car-fridge-freezer-cooler-mini-refrigerator-47-5qt-portable-lg-compressor-12-24v-p_010976387985?gclid=CjwKCAjwyryUBhBSEiwAGN5OCCfv_1jotXBqq3k7mNSMJ4JA3yqJhbTUJLCLE2FqfSyJfvgkyPYBChoCp2sQAvD_BWE.

Black+Decker, Mobile Cooler Cart, https://www.pinterest.com/pin/355362226847538542/.

Margaritaville Chill, Margaritaville 77 Quart Oval Stainless Steel Outdoor Cooler, https://www.amazon.ca/Margaritaville-Stainless-Outdoor-Cooler-Wheels/dp/B07QM33153.

TheJerryCanCompany, Jerry Can Bar Christmas, https://www.etsy.com/ie/listing/1009391558/jerry-can-bar-christmas?bp=0&epik=dj0yJnU9TWJKZ0VGcG9KTWpiMTEyQmV5OGhNSzRxYU5CdjR5M2kmcD0xJm49V0NFNmFXemxjZWFEcHNPN3hTM2x2USZ0PUFBQUFBR0tRZXVR.

Bobswoodstuff, DIY Food Can Dispenser, https://imgur.com/gallery/eG2q0RU.

Cooler Net, https://www.pinterest.com/pin/891149844987961742/.

* cited by examiner

COOLERS WITH TELESCOPING APPARATUS FOR ACCESS OF SEPARATE CONTENTS

CROSS-REFERENCE TO RELATED APPLICATION

The current application claims priority to Provisional Patent Application No. 63/416,360, filed on Oct. 14, 2022 the disclosures of which are incorporated herein by reference.

FIELD OF THE INVENTION

The present invention relates to insulating containers, and more specifically to coolers with apparatus to exchange contents without opening the main storage compartment.

BACKGROUND

Portable coolers are commonly used for various purposes, including camping, picnicking, tailgating, sporting events, and other outdoor activities. They are designed to maintain the temperature of perishable goods, beverages, and other items that require temperature-controlled storage during transportation and use.

Traditional coolers come in a variety of shapes, sizes, and materials. They can be broadly classified into two categories: passive and active coolers. Passive coolers typically rely on ice or ice substitutes to maintain the temperature inside the cooler, while active coolers employ electrical or battery-powered cooling systems.

Passive coolers are the most common type, often made of plastic, metal, or foam insulation materials. They generally use ice or ice substitutes such as gel packs, frozen water bottles, or phase change materials to provide the cooling effect. Some passive coolers incorporate additional insulation layers, which may include vacuum insulation panels or aerogel, to improve their cooling performance. However, passive coolers have several limitations, including the need for constant replenishment of ice or ice substitutes, limited cooling capacity, and susceptibility to external temperature fluctuations.

Active coolers, also known as thermoelectric coolers or powered coolers, utilize the Peltier effect to create a temperature difference across a thermoelectric module, thereby transferring heat from the inside to the outside of the cooler. Active coolers are capable of maintaining a more consistent temperature than passive coolers, but they require an external power source, such as a car battery or a portable power bank, which can limit their portability and usability in remote locations.

SUMMARY OF THE INVENTION

The various embodiments of the present coolers with telescoping apparatus (may be referred to herein as "telescoping coolers") contain several features, no single one of which is solely responsible for their desirable attributes. Without limiting the scope of the present embodiments, their more prominent features will now be discussed below. In particular, the present telescoping coolers will be discussed in the context of passive coolers without active cooling features. However, the use of passive coolers is merely exemplary and various other cooler types may be utilized as appropriate to the requirements of a specific application in accordance with various embodiments of the invention.

After considering this discussion, and particularly after reading the section entitled "Detailed Description," one will understand how the features of the present embodiments provide the advantages described here.

One aspect of the present embodiments includes the realization that in traditional coolers other than the present embodiments, the main compartment of the cooler must be opened every time the user wishes to access any of the contents. Users might accelerate the ice melting or might contaminate the interior of the cooler through accessing the main compartment repeatedly. The present embodiments solve this problem by adding an apparatus to exchange contents without opening the main storage compartment. The present embodiments thus advantageously enable:

The present embodiments provide various improvements and advantages over traditional coolers. For example, telescoping coolers provide improved cooling efficiency by allowing users to access the contents of the cooler without opening the primary opening, the telescoping cooler minimizes heat exchange and maintains the desired temperature more effectively. Further, telescoping coolers provide enhanced convenience as the telescoping design and connected carrier train provide a convenient and organized method for accessing the cooler's contents, reducing the need to rummage through the insulated container. Furthermore, telescoping coolers provide customization where the connected carrier train's compartments can be designed to accommodate various content sizes and shapes, offering flexibility and adaptability to users' needs. Moreover, telescoping coolers provide reduced energy consumption by minimizing heat exchange and maintaining the cooler's internal temperature more effectively, the telescoping cooler can potentially reduce the need for ice replenishment or power consumption in active cooling systems. In addition, telescoping coolers allow for reduced contamination as coolers are designed to be utilized in nature. By minimizing the number of times the primary compartment is opened, the user can reduce contamination with the outside world. In medical applications, this embodiment can aid in maintaining sterility. The present embodiments provide these advantages and enhancements, as further described below.

In a first aspect, a telescoping cooler for access into an insulated container is provided, the telescoping cooler comprising a telescoping bar having a compressed configuration and an extended configuration, wherein the telescoping bar in the extended configuration allows a user to exchange one or more contents of a connected carrier train without opening a primary opening of the insulated container; the connected carrier train attached to the telescoping bar, wherein the connected carrier train comprises a plurality of compartments for holding the one or more contents; a cache enclosure separating the connected carrier train from the insulated container when the telescoping bar is in the compressed configuration.

In an embodiment of the first aspect, the plurality of compartments of the connected carrier train comprises a plurality of articulated drink can holders.

In another embodiment of the first aspect, the plurality of compartments of the connected carrier train comprises a plurality of cylindrical containers with the means to hold either cans or bottles.

In another embodiment of the first aspect, the plurality of compartments of the connected carrier train further comprises: a plurality of cylindrical bodies with an open end and a closed end and a plurality of couplers enabling the plurality of cylindrical bodies to rotate relative to one another.

In another embodiment of the first aspect, the plurality of compartments of the connected carrier train comprises a first compartment having a first pair of rotary links.

In another embodiment of the first aspect, the plurality of compartments of the connected carrier train comprises a second compartment having a second pair of rotary links.

In another embodiment of the first aspect, the first compartment comprises two semi-circular end caps connected by a plurality of cradle elements.

In another embodiment of the first aspect, the first compartment comprises a plurality of end caps to limit horizontal movement of a can, an anchoring point for the first pair of rotary links, and a plurality of spring clips that applies pressure to an end of the can to maintain the can within the first compartment.

In another embodiment of the first aspect, the cache enclosure comprises a first enclosure that is angled at an aspect of the telescoping bar and a second enclosure that is parallel to a base of the main compartment.

In another embodiment of the first aspect, the telescoping bar comprises a plurality of internal locking pins for fixing the telescoping bar at a fully or partially extended position.

In another embodiment of the first aspect, the handle provides a gripping point when raising or lowering the telescoping bar.

In another embodiment of the first aspect, the telescoping bar possesses a means for locking and unlocking the configuration of the telescoping bar into a compressed configuration, an extended configuration, or a plurality of configurations in between an extended configuration and a compressed configuration.

In another embodiment of the first aspect, the cache enclosure is perforated to allow the free flow of water through the cache enclosure and an interior of the insulated container.

In another embodiment of the first aspect, the cache enclosure is removable from an interior of the main compartment of the insulated container and replaceable.

In another embodiment of the first aspect, the cache enclosure comprises a first enclosure that is angled at an aspect of the telescoping bar and a second enclosure that is horizontal to a base of the insulated container.

In another embodiment of the first aspect, the first enclosure or the second enclosure is removable from an interior of the main compartment of the insulated container and replaceable.

In a second aspect, a carrier train for easily storing and removing soda cans is provided, the carrier train comprising: a plurality of carriers connected by a plurality of rotary links enabling the carrier train to turn a plurality of corners, each carrier in the plurality of carriers further comprising, two end caps that are connected by a plurality of cradle elements, the plurality of cradle elements configured to encircle the contents by no more than 180 degrees so contents may be placed in and withdrawn from the carriers, a spring catch attached to the two end caps to catch behind a rim of the soda can such that a soda can in the carrier is retained in the carrier.

In an embodiment of the second aspect, the plurality of rotary links that join the plurality of carriers in the carrier train are not allowed to rotate around the carrier at the lower end.

In another embodiment of the second aspect, the plurality of rotary links that join the plurality of carriers in the carrier train are allowed to rotate freely around the carrier thus allowing for fluid articulation of the chain.

BRIEF DESCRIPTION OF THE DRAWINGS

The various embodiments of the present coolers with telescoping apparatus for access of separate contents now will be discussed in detail with an emphasis on highlighting the advantageous features. These embodiments depict the novel and non-obvious features shown in the accompanying drawings, which are for illustrative purposes only. These drawings include the following figures.

DETAILED DESCRIPTION OF THE DRAWINGS

Figure 1:
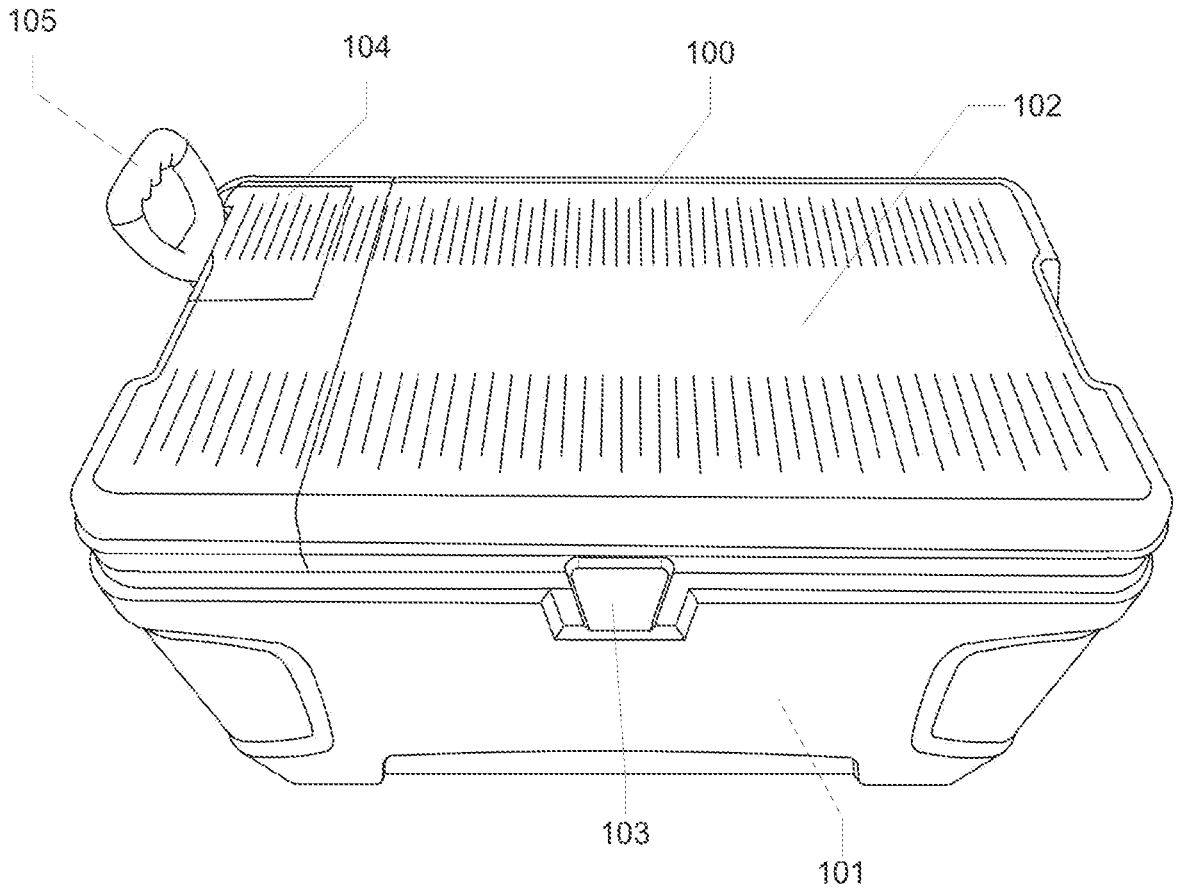
FIG. 1 is a side perspective view of a telescoping cooler in a compressed configuration in accordance with an embodiment of the invention.

The following detailed description describes the present embodiments with reference to the drawings. In the drawings, the reference numbers label elements of the present embodiments. These reference numbers are reproduced below in connection with the discussion of the corresponding drawing features.

Turning now to the drawings, a cooler with a telescoping apparatus (may be referred to herein as a "telescoping cooler") for access of contents within an insulated container of the telescoping cooler are provided. In many embodiments, telescoping coolers may include a telescoping bar having a compressed configuration and an extended configuration. In various embodiments, the telescoping bar in the extended configuration allows a user to exchange one or more contents without opening a primary opening of the insulated container. For example, a drink can may be stored and received using a mechanism (may also be referred to herein as a "cache") that allows a user to load drink cans into the coldest region of the insulated container (e.g., the interior bottom) without disturbing the contents of the insulated container or opening the cooler top (may also be referred to as a "primary opening").

In several embodiments, the cache mechanism of the telescoping cooler may be provided using a connected carrier train attached to the telescoping bar, where the connected carrier train includes one or more compartments for holding the one or more contents (e.g., cans). In many embodiments, the telescoping cooler may also include a cache enclosure separating the connected carrier train from the insulated container when the telescoping bar is in the compressed configuration, as further described below. Compressed configurations of telescoping coolers in accordance with embodiments of the invention are further discussed below.

Compressed Configurations of Telescoping Coolers

In many embodiments, telescoping coolers may include a handle joined to a closure panel that enables the user to operate a telescoping bar. In various embodiments, the cache can be unlocked or locked in an open, closed or intermediate orientation using a button or switch. In some embodiments, the carrier train of the cache is configured to hold drinks. For example, such drinks can be a standard aluminum soda can design that has a pop-tab and a narrowed bottom and top. In some embodiments, the carrier train can be configured to store bottles or be configured to store bottles and cans.

Figure 2:
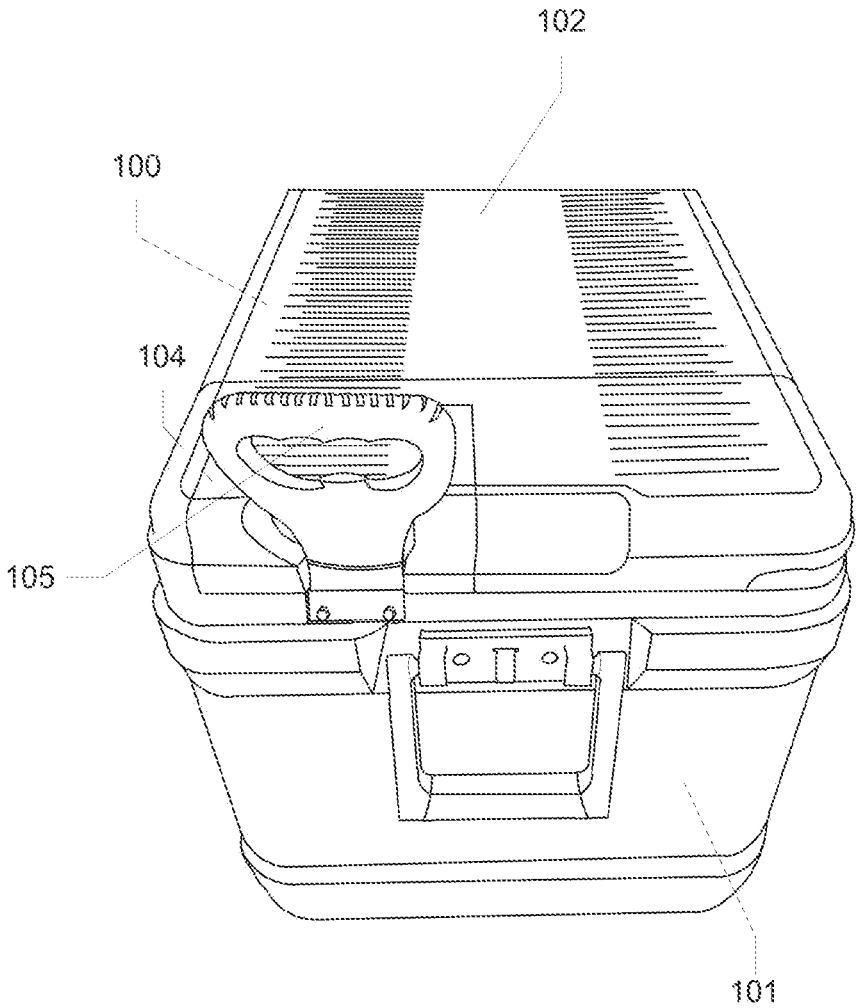
FIG. 2 is a front perspective view of a telescoping cooler in a compressed configuration in accordance with an embodiment of the invention.

A side perspective view of a telescoping cooler 100 in a compressed configuration in accordance with an embodiment of the invention is shown in FIG. 1. A front perspective view of a telescoping cooler 100 in a compressed configuration in accordance with an embodiment of the invention FIG. 2. The telescoping cooler 100 may include a rotational molded double walled body 101 and a hinged top 102 filled with an insulating high-density polyurethane expanded foam. In some embodiments, the telescoping cooler 100 can be made of plastic, such as polyethylene or polypropylene, if materials that are lightweight, durable, and resistant to moisture and temperature fluctuations are needed. Plastic surfaces are also easy to clean and maintain. In some embodiments, the telescoping cooler 100 can be made from foam insulation. In such embodiments, the insulating layer is made of foam materials, such as expanded polystyrene (EPS), extruded polystyrene (XPS), or polyurethane foam, materials that have excellent thermal insulation properties, which help keep the contents of the telescoping cooler 100 cold or hot, depending on the intended use.

The telescoping coolers may also feature metal components, such as hinges, handles, or latches, to provide additional durability and strength. Aluminum and stainless steel are common metal materials used for these components, as they are resistant to rust and corrosion. In various embodiments, rubber or silicone gaskets may be used to create an airtight seal between the lid and the telescoping cooler body, preventing the exchange of air between the interior and exterior of the telescoping cooler to help maintain the temperature inside the telescoping cooler and increases its efficiency. In some embodiments, the telescoping cooler can be soft-sided, which is lighter and more flexible than hard-sided telescoping coolers, and often use fabric materials like nylon, polyester, or vinyl for their outer shell. These materials are typically waterproof or water-resistant, and they may be combined with foam insulation to provide temperature control. In additional embodiments, the components of the telescoping cooler can be made from inexpensive biodegradable materials, such as cardboard or wood.

The hinged top is secured in a closed position using heavy duty quick release latches, such as latch 103. Additional features that may be provided depending on embodiments are wheels and a pull handle or handles for carrying the telescoping cooler 100 for the purpose of locomotion. In some embodiments, the hinged top has a cutaway closure panel 104 and a handle 105 connected to the cutaway closure panel 104. This component enables the user to operate the telescoping functionality of the interior cache. In some embodiments, the cutaway closure panel 104 or the handle 105 may contain a locking mechanism to enable the user to temporarily fix and unfix the extension of the boom at a fully extended, fully compressed, or intermediate extension between fully extended and fully compressed to allow the user to access the interior contents of the cache without simultaneously manipulating the handle or panel while retrieving from or placing an item into storage in the cache. In some embodiments, the telescoping boom component may include a plurality of segments that slide within one another, allowing the boom to be extended or retracted to a desired length. The boom can be extended by pulling on the outermost segment, which in turn extends the other segments in a telescoping manner. In certain embodiments, the locking mechanism may include a button, a lever, or any other suitable means for locking and unlocking the telescoping boom. In some embodiments, the locking mechanism may engage with notches or grooves in the telescoping segments to prevent the boom from extending or retracting beyond a predetermined position.

In some embodiments, the boom can be expanded by pulling on the handle or cutaway closure panel and retracted by pushing the segments back into one another. In some embodiments, the boom does not need to be pushed to be collapsed but is collapsed by the force of gravity. In some embodiments, a locking mechanism must be toggled before this extension or retraction takes place.

Although specific telescoping coolers in a compressed configuration are discussed above with respect to FIGS. 1-2, any of a variety of telescoping coolers, configurations, and components can be utilized in accordance with embodiments of the invention. Extended configurations of telescoping coolers in accordance with embodiments of the invention are discussed further below.

Extended Configurations of Telescoping Coolers

Figure 3:
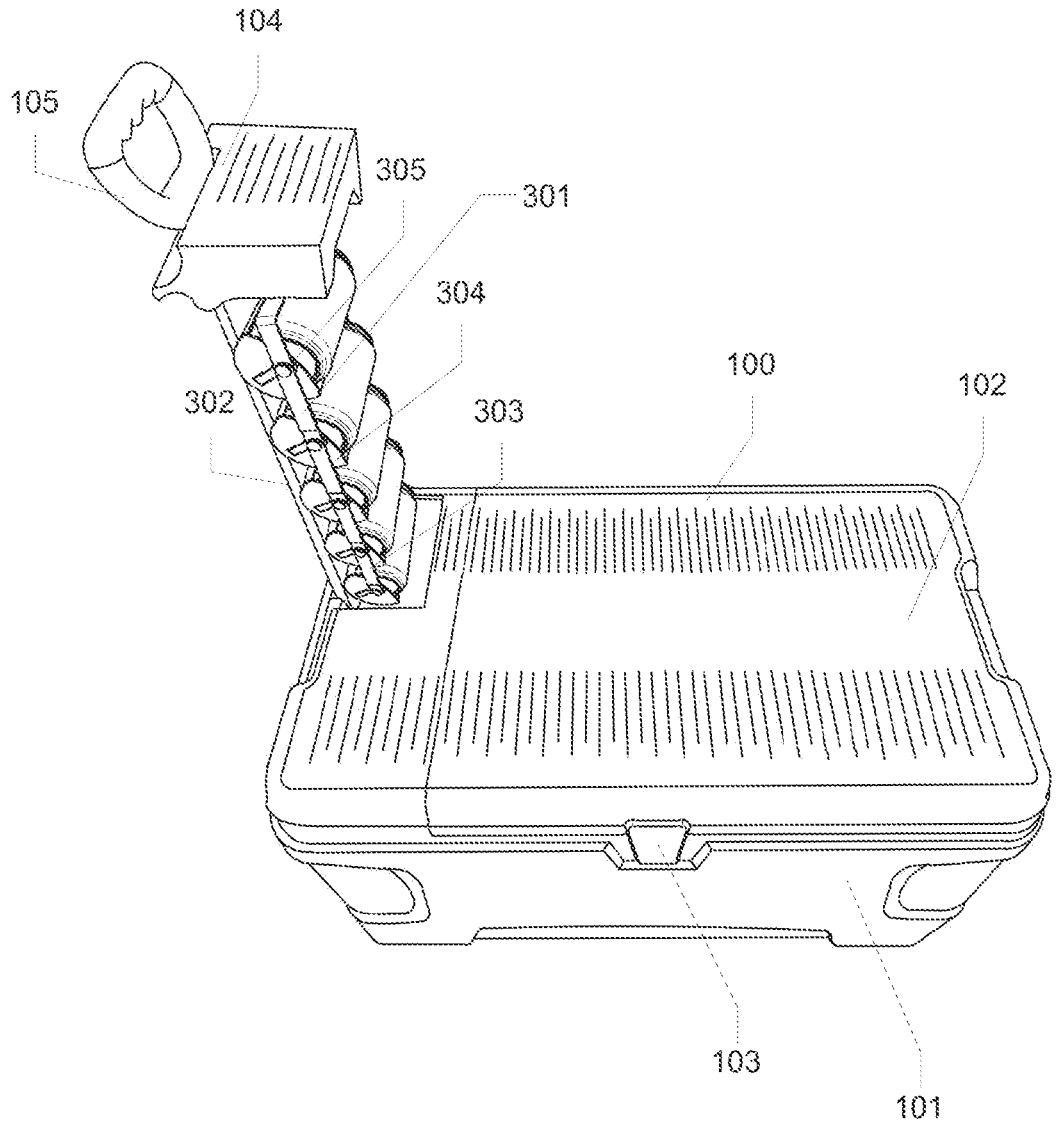
FIG. 3 is a side perspective view of a telescoping cooler in an extended configuration in accordance with an embodiment of the invention.
Figure 4:
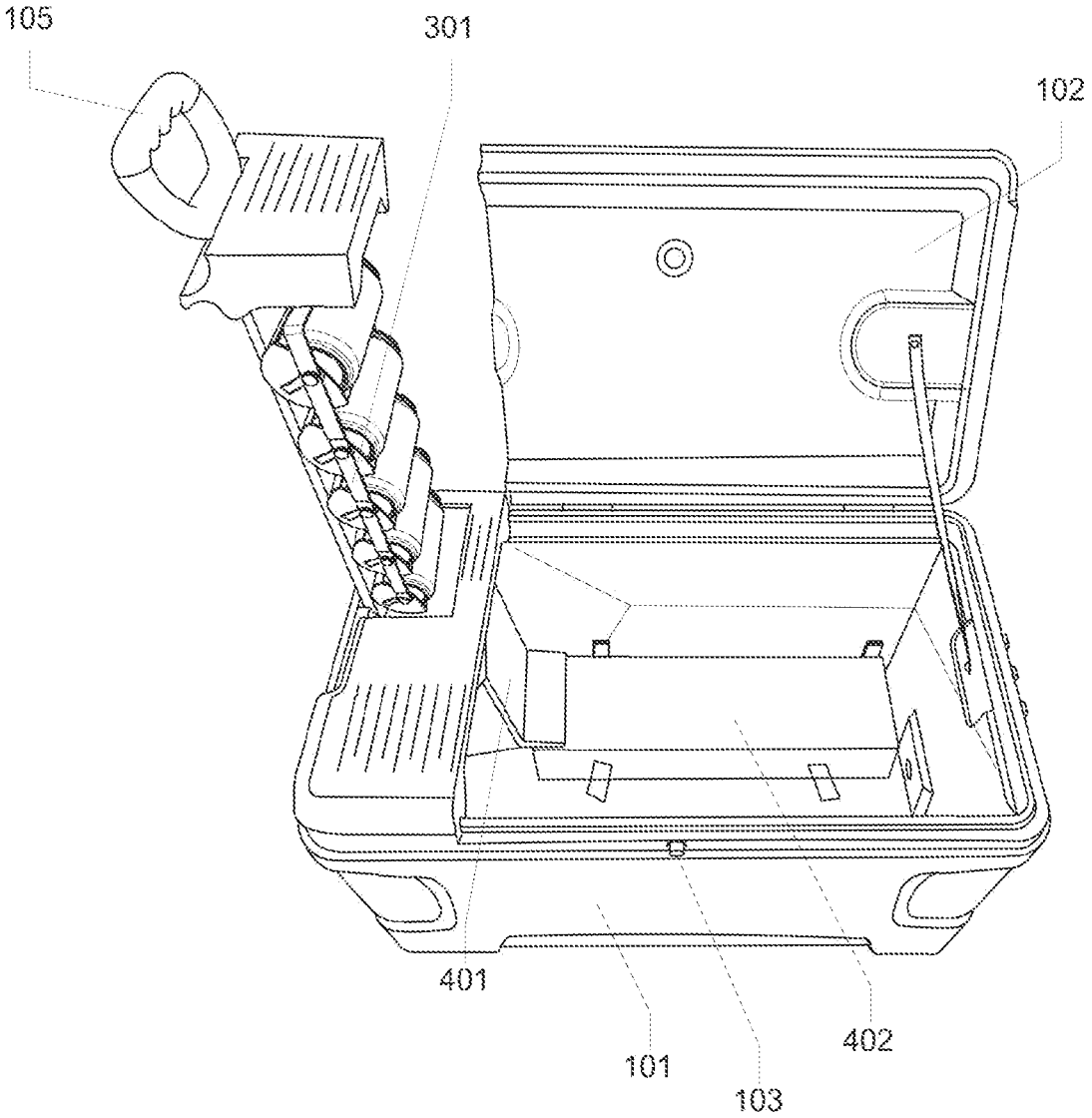
FIG. 4 is a side perspective view of a telescoping cooler in an extended configuration with an open insulated container in accordance with an embodiment of the invention.

A side perspective view of a telescoping cooler in an extended configuration in accordance with an embodiment of the invention is shown in FIG. 3. A side perspective view of a telescoping cooler 100 in an extended configuration with an open insulated container in accordance with an embodiment of the invention FIG. 4. FIGS. 3 and 4 illustrate the telescoping cooler 100 of FIGS. 1 and 2 with like elements designated by like reference numerals. In reference to FIGS. 3-4, the telescoping cooler 100 may include a train of carriers 304 as a part of cache 301 that may be withdrawn (i.e., extended) from the telescoping cooler 100 by lifting handle 105.

Figure 5:
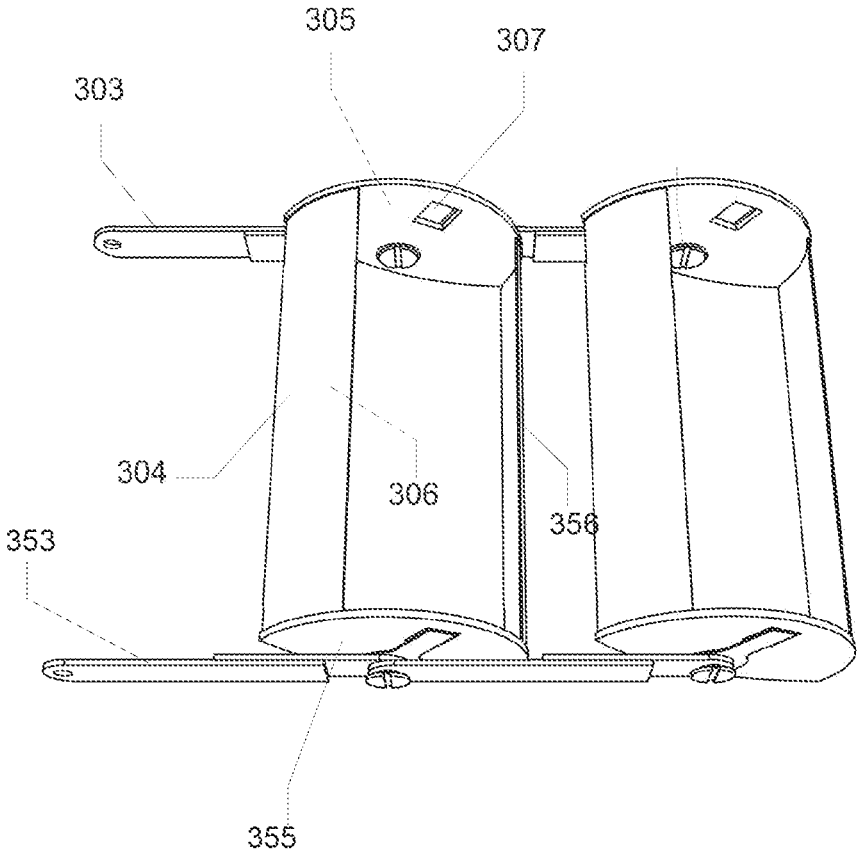
FIG. 5 is a side perspective view of adjacent carrier pods in a carrier train in accordance with an embodiment of the invention.

In reference to FIG. 3, each carrier 304 has a pair of end caps 305 joined by cradle elements (as further depicted in FIG. 5). In some embodiments, the cache apparatus comprises lid 104, connected to a telescoping bar 302, and a carrier train. In some embodiments, each carrier in the carrier train is designed to carry a single soda can. Carriers 304 are connected to adjacent carriers by a pair of rotary links 303, one on each side of the carrier, allowing the train to flexibly navigate the interior of the cache. In many embodiments, the connected carrier train 304 is affixed to the bottom of the cutaway closure panel 104 or the handle 105. In some embodiments, the connected carrier train 304 is only connected to the bottom of the closure panel, and slides against the interior of the cache without being attached.

In reference to FIG. 4, FIG. 4 illustrates a view of FIG. 3 with the lid 102 raised, revealing interior elements. Inside the telescoping cooler body, there is a first enclosure 401, angled to match the aspect of telescoping bar 302, and a second enclosure 402, positioned horizontally. In some embodiments, these enclosures separate the carrier train, with or without soda cans, from any other items in the telescoping cooler. This separation prevents items in the telescoping cooler other than the cans in the carriers from interfering with the carrier train. In some embodiments, the first enclosure 401 and the second enclosure 402 can be fused into a single continuous enclosure. In some additional embodiments, the cache enclosure can be removed entirely.

In some embodiments, the first enclosure 401 and second enclosure 402 or a single fused combination is perforated to allow for free flow of water or an alternative cooling medium through the enclosures and the interior of the telescoping cooler. In other embodiments, the first enclosure 401 and second enclosure 402 are detachable and re-attachable for cleaning and maintenance purposes. In some embodiments, the first enclosure 401 and second enclosure 402 are fused into one continuous enclosure. In additional embodiments, the first enclosure and second enclosure are watertight with respect to the main compartment of the telescoping cooler. In other embodiments, the enclosure is airtight with respect to the main compartment of the telescoping cooler.

Although specific telescoping coolers with extended configurations are discussed above with respect to FIGS. 3-4, any of a variety of telescoping coolers, configurations, and components can be utilized in accordance with embodiments of the invention. Connected carrier trains of telescoping coolers in accordance with embodiments of the invention are discussed further below.

Connected Carrier Trains of Telescoping Coolers

Telescoping coolers may include connected carrier trains that may be utilized to readily retrieve items stored in inside a cache. A side perspective view of adjacent carrier pods in a carrier train in accordance with an embodiment of the invention is shown in FIG. 5. FIG. 5 is an illustration of two carrier pods 304 of the carrier train connected by rotary links 303, 353. In certain embodiments, the connection by the rotary links enables the carrier train to be pulled out of enclosure 402, to turn a corner into enclosure 401 and to follow up the angled track to the orientation (see also FIGS. 3 and 4). The carrier pods 304 comprise two semi-circular end caps 305, 355 that are connected by curved cradle elements 306, 356 forming the carrier pod 304. End caps 305, 355 serve multiple functions, as further described below.

Figure 6:
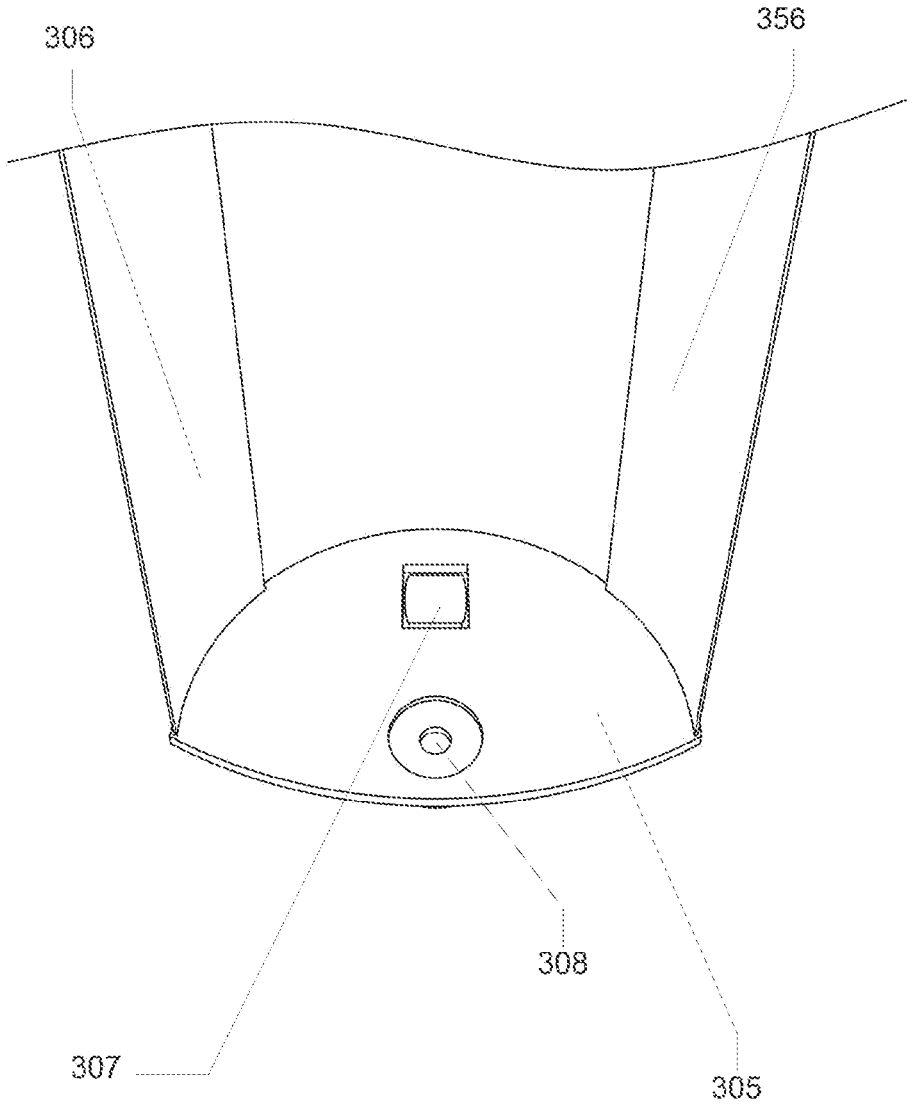
FIG. 6 is a cross sectional view of a carrier pod in accordance with an embodiment of the invention.

A cross sectional view of a carrier pod in accordance with an embodiment of the invention is shown in FIG. 6. The end caps serve to limit horizontal movement of the can, provide an anchoring point for the rotary links and incorporate a spring clip which functions to apply pressure to the end of a can nested within the holder, maintaining the can within the carrier pod 304. Further, FIG. 6 provides an inside view of one end of a carrier pod 304 illustrating a center point 308 where rotary links 303 are connected. There is a spring catch 307 on each end to catch behind a rim of the soda can such that a soda can in the carrier is retained in the carrier, but soda cans may be easily removed from the carrier pods and others placed in the carrier pods.

Figure 7:
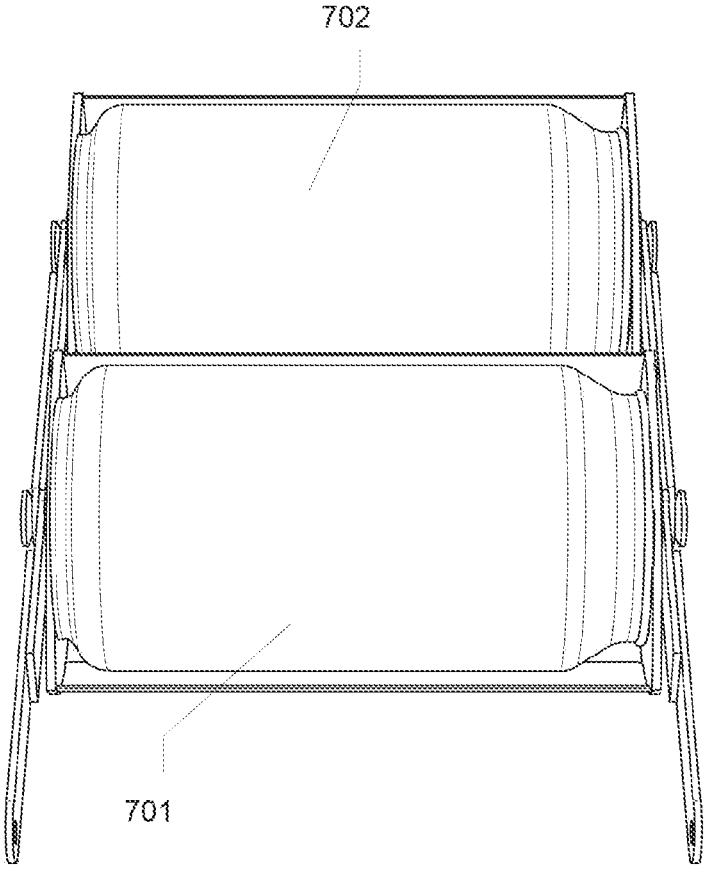
FIG. 7 is a back perspective view of carrier pods each loaded with a soda can in accordance with an embodiment of the invention.
Figure 8:
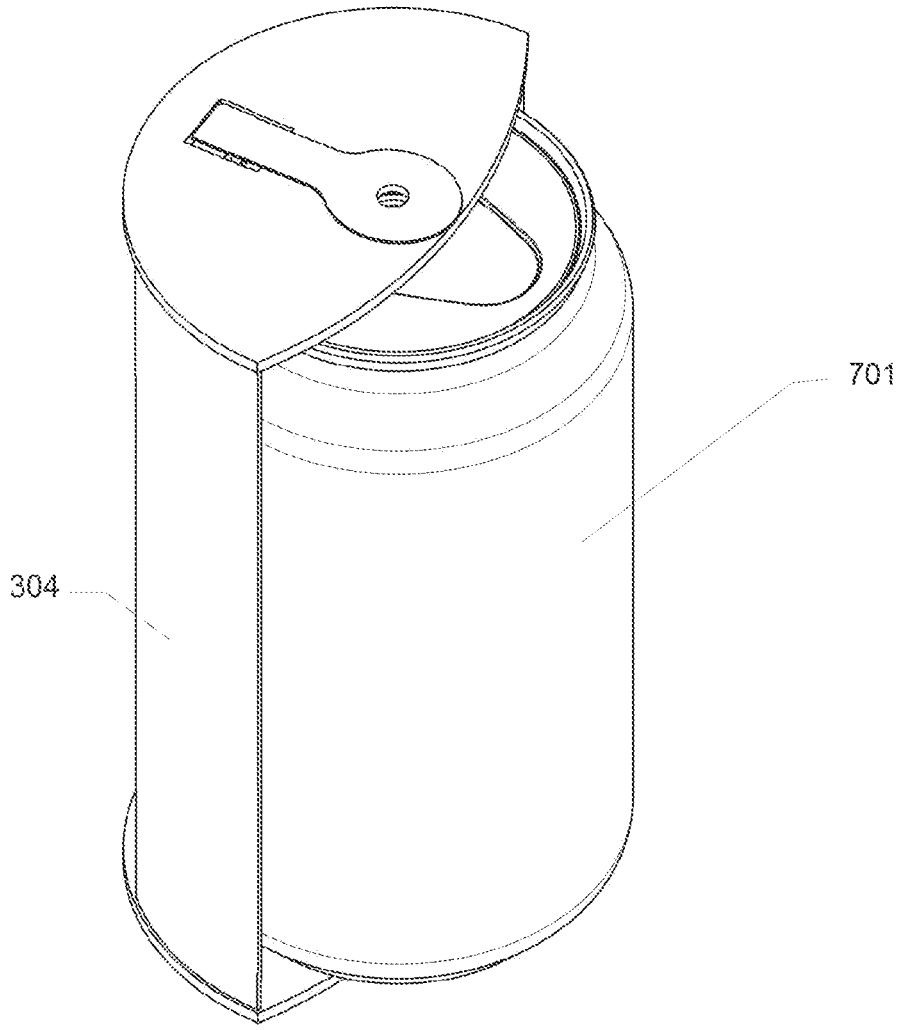
FIG. 8 is a perspective view of an upright carrier loaded with a soda can in accordance with an embodiment of the invention.

A back perspective view of carrier pods each loaded with a soda can 701, 702, respectively, in accordance with an embodiment of the invention is shown in FIG. 7. A perspective view of an upright carrier loaded with a soda 701 can in accordance with an embodiment of the invention is shown in FIG. 8. Specifically, FIG. 8 is another view of carrier pod 304 without the rotary links attached to the carrier, but with a soda can 701 in place. In some embodiments, cradle elements 306 are limited to encircling the can by no more than 180 degrees so cans may be placed in and withdrawn from the carrier pods.

Figure 9:
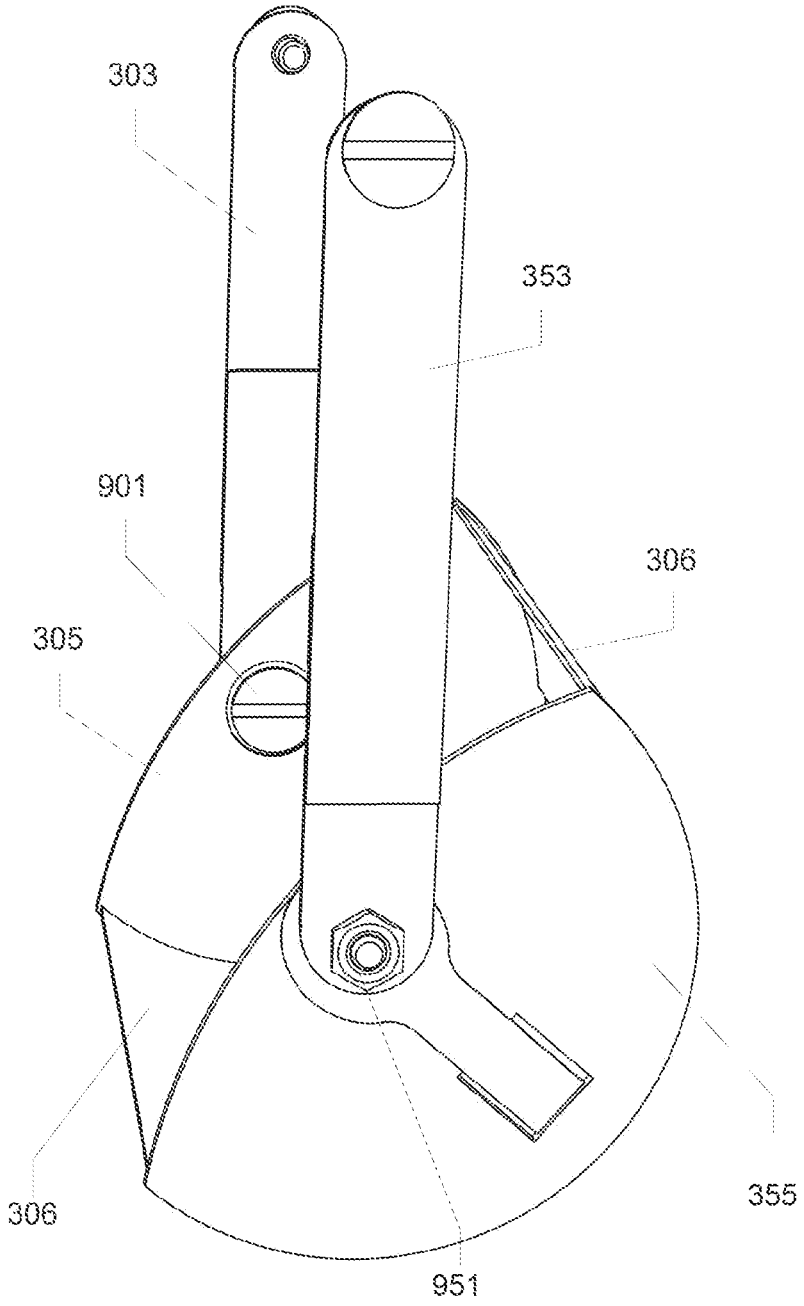
FIG. 9 is a perspective view of an upright carrier and links of a carrier pod in accordance with an embodiment of the invention.

A perspective view of an upright carrier and links of a carrier pod in accordance with an embodiment of the invention is shown in FIG. 9. FIG. 9 illustrates one carrier pod 304 joined on each end cap 305, 355 to a rotary link 303, 353, respectively. In this embodiment and some embodiments, links 303, 353 are attached to carrier end cap 305, 355 by nut 901, 951, respectively, and this is a rigid fastening. In some embodiments, link 901 does not rotate relative to the end cap 305. The same is true at end cap 305 on the opposite side of carrier pod 304. With the link 303 oriented vertically, as seen in FIG. 9 or as in FIGS. 3 and 4, the carrier pods are held with the bottom leading edge of the front cradle element 306 at approximately 145 degrees. This orientation keeps cans in the cradles whether the telescoping cooler is in an extended or compressed configuration of the telescoping coolers.

In some embodiments, to extract a can from the carrier it is necessary to pull the can slightly upward while pulling horizontally. The rotary links that join the carrier pods are not allowed to rotate around the carrier pod at the lower end, ensuring that the carrier pod is always rotated to the proper position. In certain embodiments, each rotary link is connected to two adjacent carrier pods. When suspended in the vertical orientation, such as when the telescoping apparatus is in an open configuration, the lower carrier does not allow the rotary link to move around it. The rotary link is rigidly fixed to the carrier pod so that when it is hanging vertically, the carrier pod is rotated to the correct orientation. The upper end of the rotary link can rotate freely around the carrier pod, allowing for fluid articulation of the chain.

Figure 10:
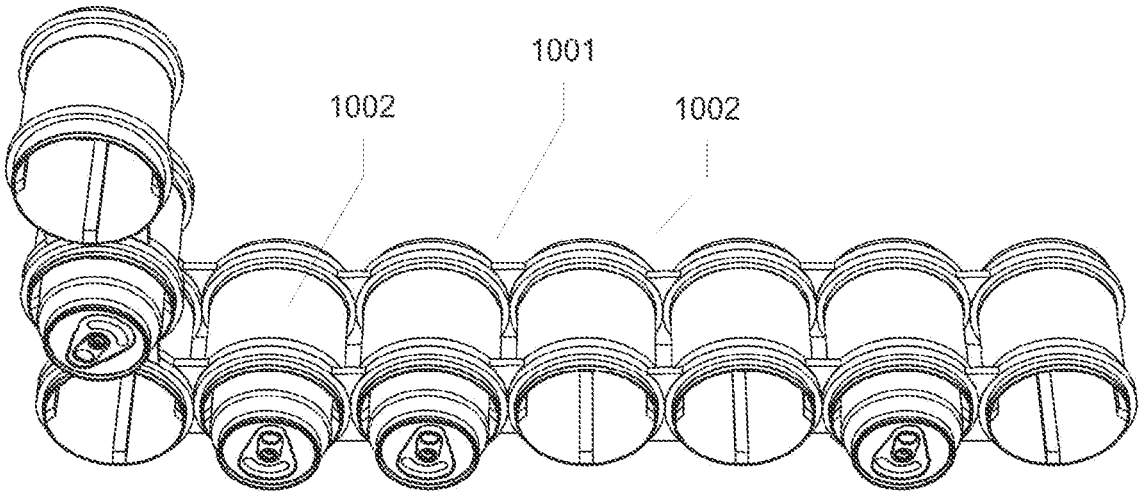
FIG. 10 is a perspective view of another carrier train in accordance with an embodiment of the invention.
Figure 11:
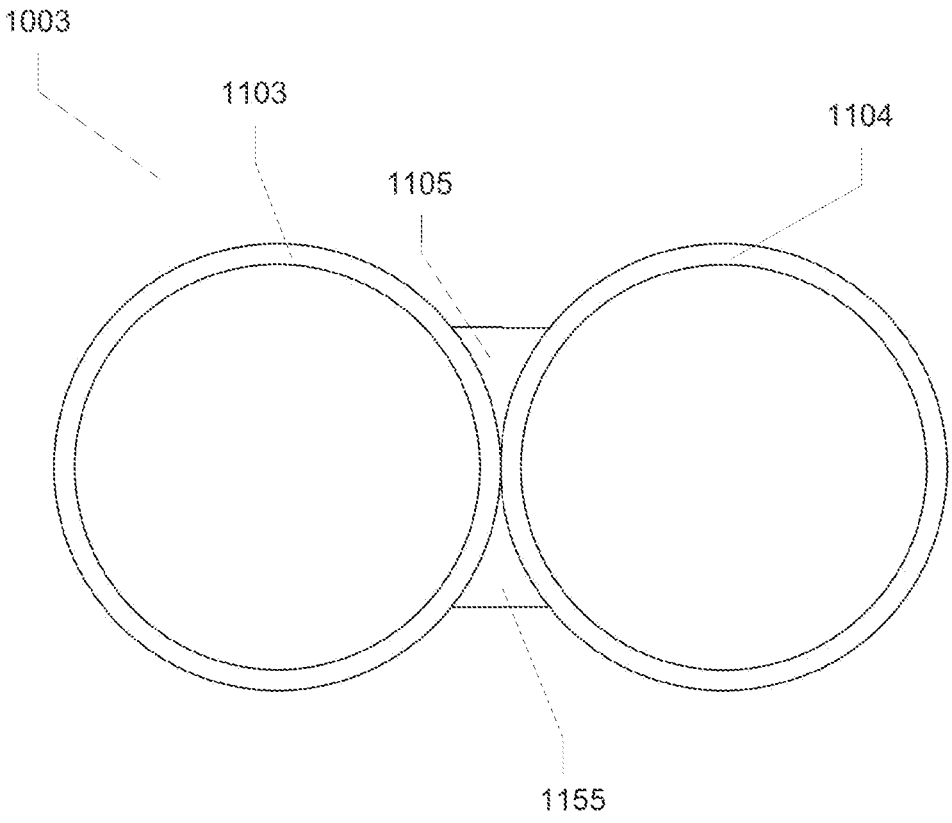
FIG. 11 is a top view of a coupling assembly of a carrier train in accordance with an embodiment of the invention.

A perspective view of another carrier train in accordance with an embodiment of the invention is shown in FIG. 10. FIG. 10 illustrates an alternative embodiment of carrier train 1001 with individual carrier pods 1002 coupled by a coupler 1003. In many embodiments, this carrier train might be substituted for the carrier train shown in FIGS. 3 and 4. In some embodiments, this mechanism is designed to store bottles and cans. A top view of a coupling assembly of a carrier train in accordance with an embodiment of the invention is shown in FIG. 11. FIG. 11 illustrates coupler 1003, comprising two joined rings 1103 and 1104, each ring with an inside diameter that is a slip fit to the outside diameter of the cylindrical housing of carrier pod 1002. Reinforcing filler elements 1105, 1155 of the same thickness as the rings are added where the rings join to provide greater strength.

Figure 12:
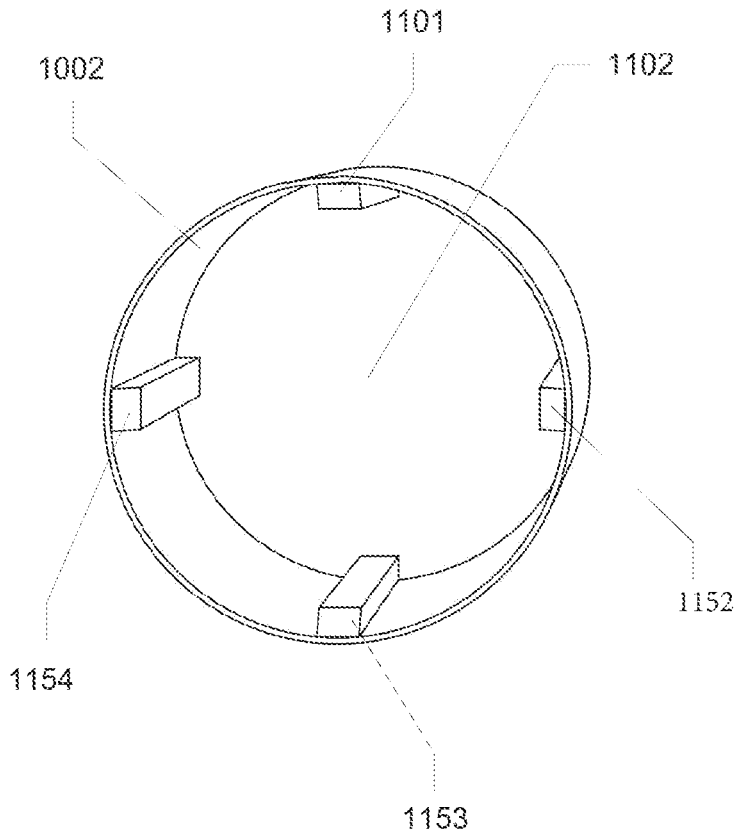
FIG. 12 is a perspective view of a carrier in accordance with an embodiment of the invention.

A perspective view of a carrier in accordance with an embodiment of the invention is shown in FIG. 12. FIG. 12 illustrates carrier pod 1002, which has a cylindrical body with an open end and a closed end 1102. Four guide rails 1101, 1152, 1153, 1154 are fastened at 90-degree intervals around the inside of carrier 1002, such that a can or a bottle can fit just inside the guide rails.

Figure 13:
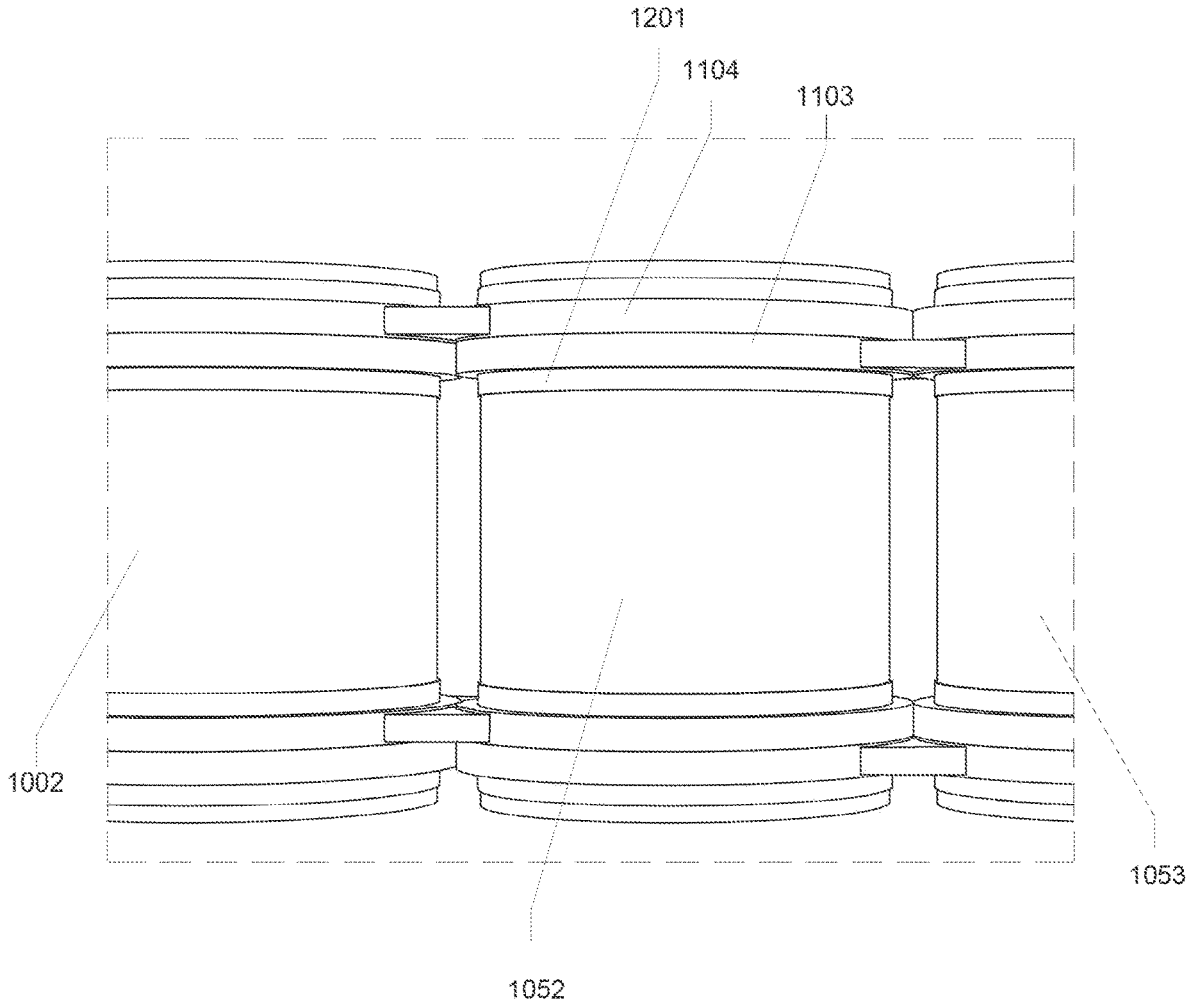
FIG. 13 is a top view illustrating coupling of carrier pods of a carrier train in accordance with an embodiment of the invention.

A top view illustrating coupling of carrier pods of a carrier train in accordance with an embodiment of the invention is shown in FIG. 13. Three carrier pods 1002, 1052, 1053 sequential in the carrier train are shown. Each carrier cylinder has bands 1201 on the outside diameter, two spaced apart by twice the width of a ring 1103 or 1104 proximate to one end of the carrier cylinder, and two more spaced apart by the same distance proximate to the other end of the carrier cylinder. In some embodiments, the bands are assembled from strips of plastic or another rigid material applied around the cylinders with adhesive. The space between the two bands proximate to each end of the carrier constrains rings of two couplers in operation. Prior to assembly inner bands are implemented on each end of carrier pod in the carrier train. Then an inner coupler is coupled to two adjacent carrier pods on each end of the carrier pods. This is done for each set of two carrier pods in the row of carrier pods, except the initial and final carrier pod in the carrier train, producing a plurality of joined carrier sets of two carriers. Then each set is joined to an adjacent set of two carriers by an outer coupler, and the carrier train is assembled. The last step in the assembly is to attach the outer bands 1201 on each end of each carrier pod in the train. The product of the described assembly process is a carrier train wherein the carrier pods are free to rotate relative to one another. In many embodiments, the carrier train, as described above, may be used much as the carrier train of FIGS. 3 and 4.

In some embodiments, alternative carrier trains can be designed and manufactured for the purpose of storing food, medications, or any other item a user would find important to keep at a cold or warm or constant temperature and easily retrieve. In some embodiments, the carrier pods could fully enclose the contents and be sealable with respect to the cache enclosure.

In some embodiments, a single telescoping cooler could contain multiple cache apparatuses, each with their own connected carrier train and telescoping mechanism. In other embodiments, the connected carrier train could be folded or wrapped around the interior of the cache such that it vertically stacks to enable a longer carrier train.

Although specific connected carrier trains of telescoping coolers are discussed above with respect to FIGS. 5-12, any of a variety of carrier trains can be utilized in accordance with embodiments of the invention. While the above description contains many specific embodiments of the invention, these should not be construed as limitations on the scope of the invention, but rather as an example of one embodiment thereof. It is therefore to be understood that the present invention may be practiced otherwise than specifically described, without departing from the scope and spirit of the present invention. Thus, embodiments of the present invention should be considered in all respects as illustrative and not restrictive.

What is claimed is:

1. A telescoping cooler for access into an insulated container, the telescoping cooler comprising:

a telescoping bar having a compressed configuration and an extended configuration, wherein the telescoping bar in the extended configuration allows a user to exchange one or more contents of a connected carrier train without opening a primary opening of the insulated container;

the connected carrier train attached to the telescoping bar, wherein the connected carrier train comprises a plurality of compartments for holding the one or more contents;

a cache enclosure separating the connected carrier train from the insulated container when the telescoping bar is in the compressed configuration, wherein the cache enclosure comprises a first enclosure that is angled at an aspect of the telescoping bar and a second enclosure that is horizontal to a base of the insulated container.

2. The telescoping cooler of claim 1, wherein the plurality of compartments of the connected carrier train comprises a plurality of articulated drink can holders.

3. The telescoping cooler of claim 1, wherein the plurality of compartments of the connected carrier train comprises a first carrier pod that is connected to the connected carrier train by a pair of rotary links.

4. The telescoping cooler of claim 3, wherein the plurality of compartments of the connected carrier train comprises a second carrier pod that is connected to the connected carrier train by the pair of rotary links.

5. The telescoping cooler of claim 4, wherein the first carrier pod comprises two semi-circular end caps, wherein the two semi-circular end caps are connected by a plurality of cradle elements.

6. The telescoping cooler of claim 3, wherein the first carrier pod comprises a plurality of end caps to limit horizontal movement of a can.

7. The telescoping bar of claim 1 further comprising a handle, wherein the handle provides a gripping point when raising or lowering the telescoping bar.

8. The telescoping cooler of claim 1, wherein the cache enclosure is perforated to allow the free flow of water through the cache enclosure and an interior of the insulated container.

9. The telescoping cooler of claim 1, wherein the cache enclosure is removable from an interior of the main compartment of the insulated container and replaceable.

10. The telescoping cooler of claim 1, wherein the first enclosure or the second enclosure is removable from an interior of a main compartment of the insulated container and replaceable.

11. The telescoping cooler of claim 1, wherein the first enclosure and the second enclosure are a single continuous enclosure.

12. A carrier train for easily storing and removing soda cans, the carrier train comprising:

a plurality of carriers connected by a plurality of rotary links enabling the carrier train to turn a plurality of corners, each carrier in the plurality of carriers further comprising, two end caps that are connected by a plurality of cradle elements, the plurality of cradle elements configured to encircle the contents by no more than 180 degrees so contents may be placed in and withdrawn from the carriers, a spring catch attached to the two end caps to catch behind a rim of the soda can such that a soda can in the carrier is retained in the carrier.

13. The carrier train of claim 12, wherein the plurality of rotary links that join the plurality of carriers in the carrier train are not allowed to rotate around the carrier at the lower end.

14. The carrier train of claim 13, wherein the plurality of rotary links that join the plurality of carriers in the carrier train are allowed to rotate freely around the carrier thus allowing for fluid articulation of the chain.

* * * * *